US007458545B1

(12) United States Patent
Ricks et al.

(10) Patent No.: US 7,458,545 B1
(45) Date of Patent: Dec. 2, 2008

(54) SYSTEM FOR SENDING COMMANDS TO TRAIN CARS BASED ON LOCATION IN TRAIN

(75) Inventors: John T. Ricks, Lincoln Park, MI (US); Louis G. Kovach, II, Belleville, MI (US); Neil Young, Woodside, CA (US); Mark E. Ricks, Lincoln Park, MI (US)

(73) Assignee: Liontech Trains LLC, Chesterfield, MI (US)

( * ) Notice: Subject to any disclaimer, the term of this patent is extended or adjusted under 35 U.S.C. 154(b) by 564 days.

(21) Appl. No.: 11/188,117

(22) Filed: Jul. 22, 2005

(51) Int. Cl.
*B61L 23/00* (2006.01)

(52) U.S. Cl. ..... 246/1 R; 246/1 C; 246/473 A; 701/19; 340/933

(58) Field of Classification Search ..... 340/438, 340/536, 538, 825.34, 825.69, 825.72, 933; 246/167 R, 1 R, 122 A, 187 A, 3, 4, 187 C, 246/473 A; 701/19
See application file for complete search history.

(56) References Cited

U.S. PATENT DOCUMENTS 5,174,216 A * 12/1992 Miller et al. ..... 104/296
5,777,547 A * 7/1998 Waldrop ..... 340/438
6,655,640 B2 * 12/2003 Wolf et al. ..... 246/167 R

* cited by examiner

*Primary Examiner*—Mark T Le
(74) *Attorney, Agent, or Firm*—O'Melveny & Myers LLP

(57) ABSTRACT

A model train system is provided, comprising a command originator, layout objects, and a communication link. The communication link may be established through the use of magnetic induction coils/transceivers placed at the ends of each layout object. Commands sent by a user via a remote base to the command originator are forwarded to the subsequent layout objects. For addressing, a command index is incremented by each layout object, until it matches the position number of the layout object. Examples of such commands are opening/closing couples which physically connect cars, turning on/off lights, and producing bell and whistle sounds.

20 Claims, 4 Drawing Sheets

SYSTEM FOR SENDING COMMANDS TO TRAIN CARS BASED ON LOCATION IN TRAIN

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates to data protocols, and in particular command protocols for model trains.

A variety of control systems are used to control model trains. In one system, the power to the track is increased, or decreased, to control the speed and direction of the train. Multiple trains can be controlled by providing different power levels to the different sections of the track having different trains.

In another type of control system, a coded signal is sent along the track, and addressed to the desired train, giving it a speed and direction. The train itself controls its speed by converting the AC voltage on the track into the desired DC motor voltage for the train according to the received instructions. The instructions can also tell the train to turn on or off its lights, horns, etc. U.S. Pat. Nos. 5,441,223 and 5,749,547 issued to Neil Young et al. show such a system.

FIG. 1A is a perspective drawing of an example layout of a conventional model train system allowing the communication of signals from a base unit to a locomotive and other components.

A hand-held remote control unit 12 is used to transmit signals to a base unit 14 and to a power master unit 150 both of which are connected to train tracks 16. Base unit 14 receives power through an AC adapter 18. A separate transformer 20 is connected to track 16 to apply power to the tracks through power master unit 150. Power master unit 150 is used to control the delivery of power to the track 16 and also is used to superimpose DC control signals on the AC power signal upon request by command signals from the hand-held remote control unit 12.

Power master unit 150 modulates AC track power to the track 16 and also superimposes DC control signals on the track to control special effects and locomotive 24'. Locomotive 24' is, e.g., a standard Lionel locomotive powered by AC track power and receptive to DC control signals for, e.g., sound effects.

455 kHz transmitter 33 of base unit 14 is configured to transmit an outgoing RF signal between the track and earth ground, which generates an electromagnetic field indicated by lines 22 which propagates along the track. This field will pass through a locomotive 24 and will be received by a capacity antenna located inside the locomotive.

FIG. 1B is a simplified schematic drawing of the conventional system shown in FIG. 1A. FIG. 1B shows a cross-sectional view of locomotive 24, which may be, e.g., a standard locomotive retrofitted or designed to carry antenna 26. The signal will then be communicated from antenna 26 to 455 kHz receiver 37 of engine 24. Locomotive 26 further includes a processor 84 in communication with receiver 37 and configured to interpret the received signal.

Returning to FIG. 1A, receipt of control signals is not limited to moving elements of the train set. The electromagnetic field generated by base unit 14 will also propagate along a line 28 to a switch controller 30. Switch controller 30 also has a receiver in it, and will itself transmit control signals to various devices, such as the track switching module 32 or a moving flag 34.

The use of both base unit 14 and power master unit 150 allows operation and control of several types of locomotives on a single track layout. Locomotives 24 which have been retrofitted or designed to carry receiver 26 are receptive to control signals delivered via base unit 14. Standard locomotives 24' which have not been so retrofitted may be controlled using DC offset signals produced by power master unit 150.

The remote unit can transmit commands wirelessly to base unit 14, power master unit 150, accessories such as accessory 31, and could transmit directly to train engines instead of through the tracks. Such a transmission directly to the train engine could be used for newer engines with a wireless receiver, while older train engines would continue to receive commands through the tracks. An example of a remote control is described in copending application Ser. No. 10/986,459, now U.S. Pat. No. 7,221,113.

The communication of signals to moveable and stationary components of a model train as described above, offers a number of advantages. Furthermore, even more advantages would be conferred by the ability to send and receive signals to specific train set components or cars configured to perform certain functions mimicking realistic actions of a train.

A railroad communication system is disclosed in U.S. Pat. No. 4,582,280. A radio communication control system allows for a lead unit to communicate with a plurality of remote units. The radio communication channel between the lead unit and the remote units also signals responses by the remote units to the commands from the lead unit. A functional radio communications link between a lead unit and a remote unit is not established until unique addressing information has been exchanged between the lead unit and the remote unit and comparisons have been made.

U.S. Pat. No. 5,831,348, discloses a wireless transmit-receive system including a power induction coil. The system allows for transmission of a power signal in a non-contact form according to mutual induction by using an induced electromotive force generated in a coil with a magnetic field. In this wireless transmit-receive system, a typical frequency used in a low-cost electromagnetic induction system is in a range from around 100 kHz to 1 MHz.

Examples of desired signals to be sent and received to the train cars are described in U.S. Pat. No. 3,664,060 issued to Longnecker. Simulated bell sounds, whistles, and steam blow-off sounds are examples of realistic locomotive sounds to be used in model train systems. Other signals include the control of couplers which link two cars together. It is an object to send these signals to specific cars based on their order or location in a train.

U.S. Pat. No. 5,777,547, discloses a car identification and ordering system for trains which identifies each car in the train, the order of the cars, the total number of cars, and the identification of the last car in the train. A master controller sends an identification request signal to the first car. Only the first car receives this signal because the repeater on the first car is temporarily disabled, and therefore the message is not transferred to the second car or any of the successive cars in the train. The car controller on the first car responds to this signal by sending an identification signal back to the master controller which provides the master controller with information regarding the first car. The master controller stores this car identification information into the first car position in its database or list. Then, the car controller re-enables the repeater on the first car to re-establish communication between the first car and the second car. This identification process is repeated down the line of cars in a train until the last car is identified. The system will know exactly how many cars are in the train and will have the order of the cars in its database or list.

Other examples of communication systems include K-Line's unidirectional communication from remote to train and Lionel's unidirectional link between the Engine and an Engine Tender.

It is an object of the invention, however, to provide a simple model train addressing system where commands are sent to desired train set components, without disabling the communication link between the cars.

BRIEF SUMMARY OF THE INVENTION

The present invention provides a model train system for sending commands to layout objects in a model train layout system. Commands may be sent from a command base, remote unit, or any other remote command originator, to layout objects in a model train layout system, such as specific cars in a model train. A model train may consist of a master car which has a receiver configured to obtain signals from a command base. Following the master car is a group of slave cars, where each slave car is equipped with transceivers. A communication link may be established between the master car and the slave cars to allow for command signals to be passed from the command base, over to the master car, and then to the slave cars. The master car is configured to forward commands to the slave cars. Addressing of the cars is based on the location of the cars in the train.

An embodiment of the present invention comprises specific elements in the command to be sent through the communication link. The command comprises three elements: the desired information, the desired position, and an index. The desired information consists of an electronic message that translates the function to be implemented by the slave car, such as opening a front coupler, turning on lights, etc. The desired position corresponds to a location of the slave car in the train which will perform the desired action. The index is incremented as the command is passed from one car to the next, keeping track of where the command is presently stored, i.e. in which slave car the command is located. The command is passed from car to car until the desired position number matches the index, indicating the command should be performed in the matching slave car.

An embodiment of the present invention comprises induction coils placed at the end of each car and a control system used to open and close couplers that connect cars. Couplers are opened upon detection of an approaching car that has a neighboring induction coil. A communication link is established as soon as the neighboring induction coils are within range, allowing for commands to be sent back and forth.

DETAILED DESCRIPTION OF THE INVENTION

System

Figure 1A:
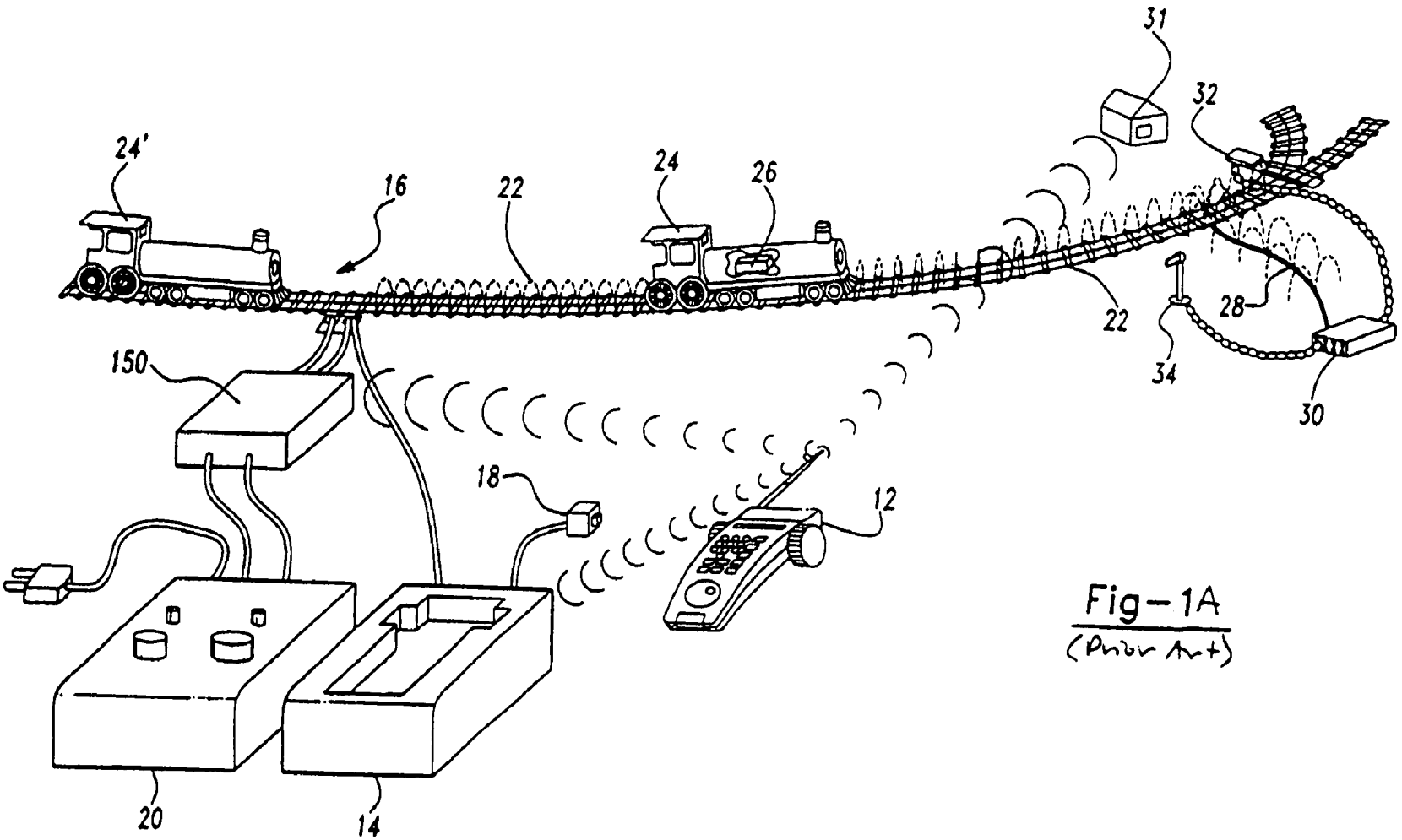
Fig-1A (Prior Art)
FIG. 1A illustrates a perspective view of an example of a model train system having commands transmitted to a train engine and accessories on the train layout.
Figure 1B:
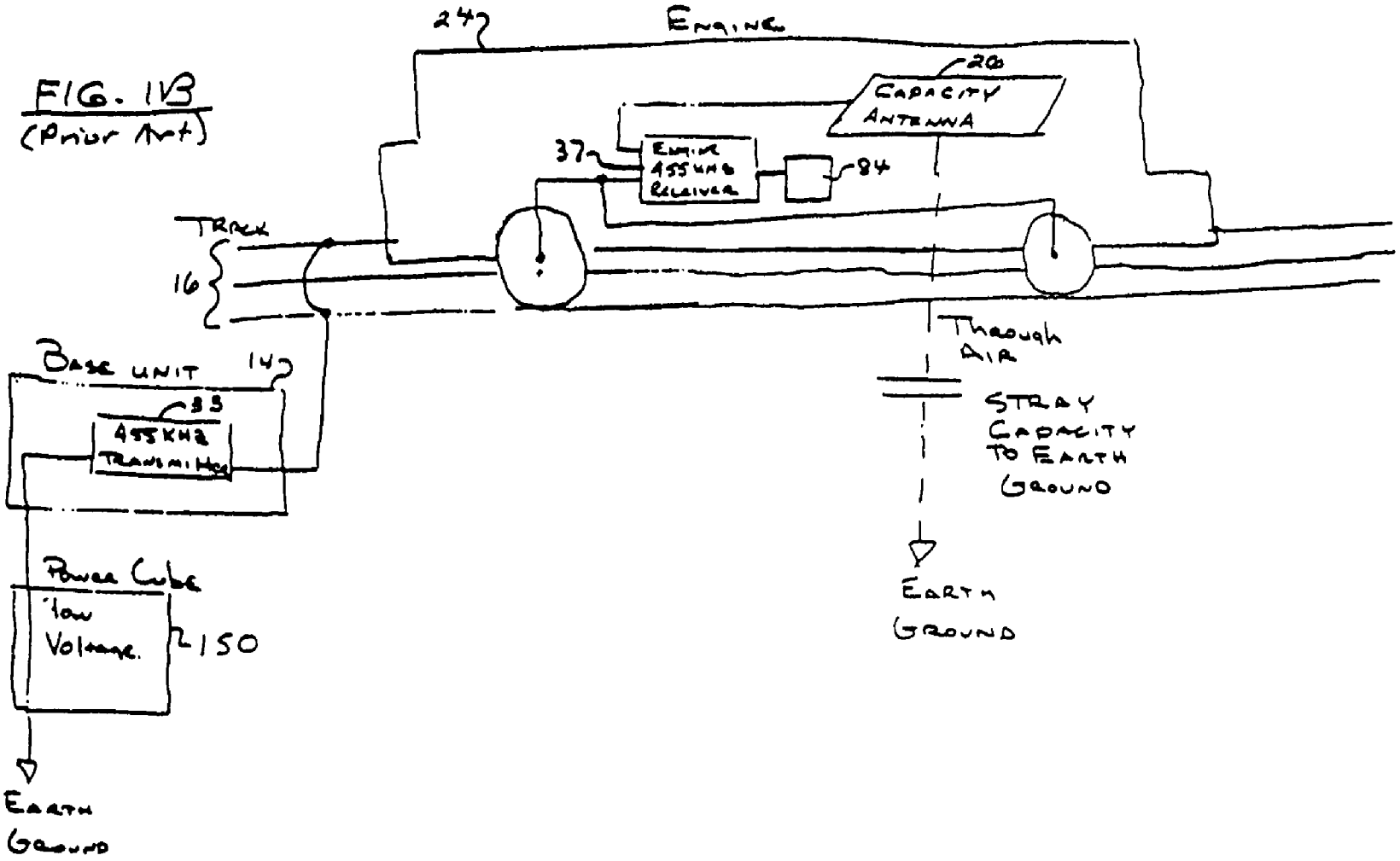
FIG. 1B (Prior Art)
FIG. 1B illustrates a simplified schematic view of the model train system of FIG. 1A.
Figure 2:
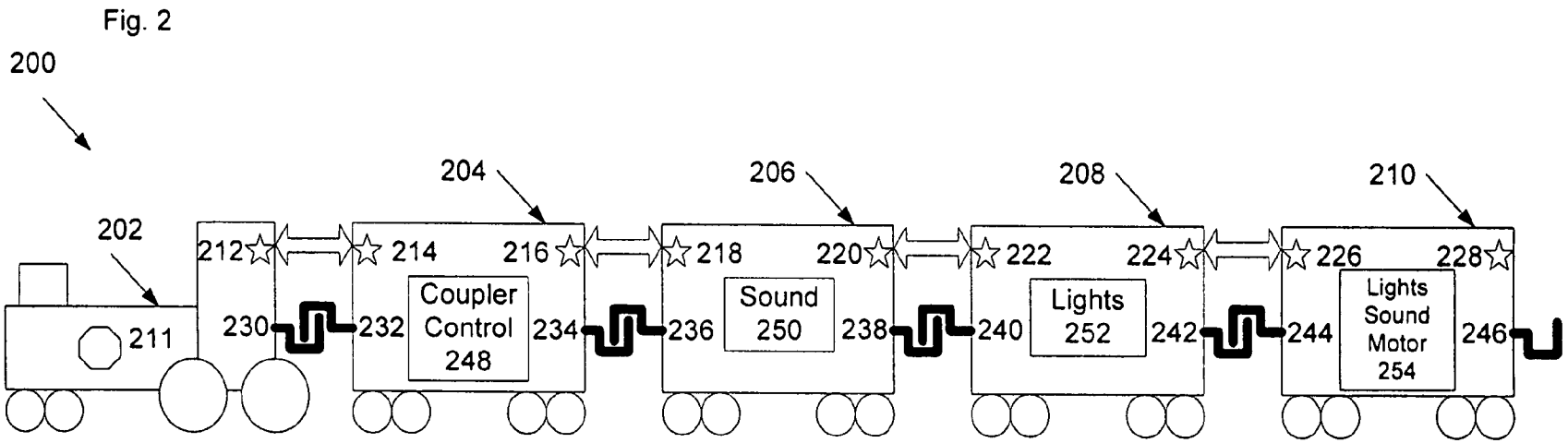
FIG. 2 illustrates an example of a model train system in accordance with the present invention having induction coils, coupler control, sound, and lights.

FIG. 2 illustrates a perspective view of an example of a model train system in accordance with the present invention. The system of FIG. 2 is compatible with the train set shown in perspective view in FIG. 1A.

Master car 202 acts as the command originator for an entire train 200. The master car is preferably mounted as the head unit, or first car, although it may be located in another location on a train. In a preferred embodiment of the present invention, master car 202 is physically connected to layout objects 204, 206, 208, and 210. In this particular example, the layout objects are slave cars; however, other layout objects exist and could be used. In other alternative embodiments, any number of slave cars may be connected to the master car, including no slave cars. The master car 202 in this example is a locomotive which contains a motor to pull the rest of the train 200. The locomotive also contains a receiver 211, which has the ability to obtain signals from model train system base 14, where a user can use remote control 12 and send commands to the train. A microcontroller and memory in the engine receive the commands from the receiver and do the processing described herein. Examples of commands to be sent to locomotive 202 are opening/closing couplers (such as coupler 230 and 232) that connect cars together, producing a bell or whistle sound, turning on/off lights, etc. Each car on the train may have the capability of executing such commands. Furthermore, each car may include a car controller with a suitable microprocessor for receiving and storing information.

Auto Coupling

Figure 3:
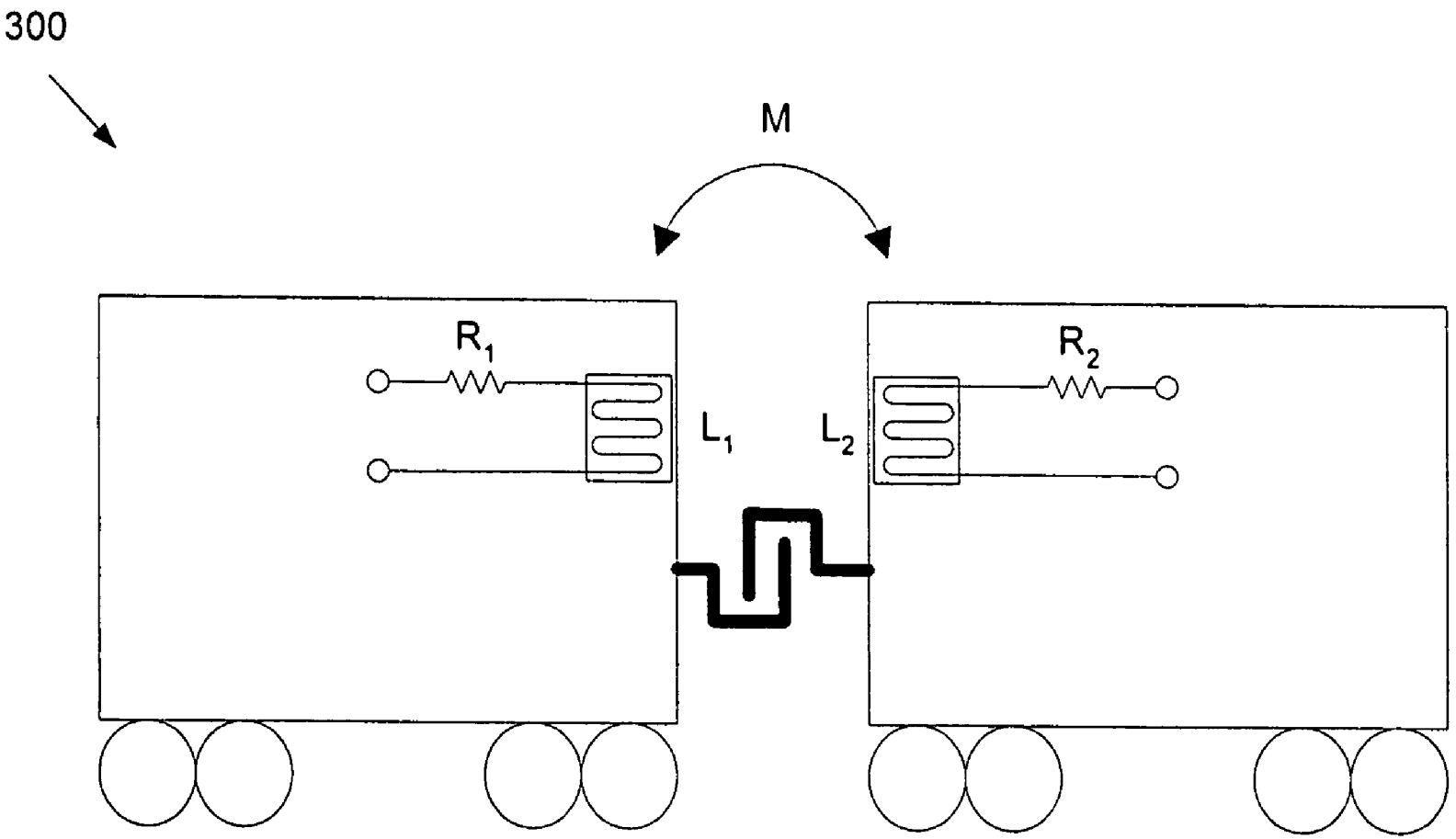
FIG. 3 illustrates a simplified circuit design of an embodiment of the present invention where neighboring induction coils are situated in a model train system.

Induction coils are placed at the ends of each car. It should be appreciated that master car 202 may only contain one induction coil 212, because no cars are normally to be placed in front of the locomotive (unless the locomotive is pushing the train, in which case there may be a transceiver in front). Transceivers 212-228 indicate possible locations for placement of the induction coils. The communication link established from these transceivers may be wired or wireless. Induction coil 212 is linked with induction coil 214, induction coil 216 is linked with induction coil 218, and so on. The use of the semi-directional magnetic field from the induction coils allows for non-aligned induction coils to still communicate with each other. For example, when two neighboring cars are rounding a curved track, the communication link between the induction coils is still maintained. FIG. 3 illustrates a simplified circuit diagram displaying the coupling of two neighboring induction coils as placed in a model train system. Neighboring induction coils $L_1$ and $L_2$ produce a mutual inductance M that allows for signals to be wirelessly transmitted between coil $L_1$ and coil $L_2$. Resistors $R_1$ and $R_2$ represent loads in the simplified circuit. Transceiver circuits are connected to the resistor/induction coil simplified circuit to transmit/receive data. Thus, information can be communicated from one car to the next car. It should be appreciated that the communication link established in this example may also consist of other types of transceivers, such as infrared (IR)

transceivers, radio frequency (RF) transceivers, or wired connections through conductive couplers. The induction coil transceivers on each slave car are constantly looking for a link to another car or locomotive. A link is established when two neighboring cars are placed within a specified threshold distance. The link can continue without having a physical connection. For example, if slave car 204 is by itself, induction coil transceivers 214 and 216 do not recognize a link with another car. As slave car 204 is placed on a railroad track, and approaches master car 202, induction coil transceiver 212 and 214 recognize that both cars are within the threshold distance, and thus establish a communication link. Once this occurs, the commands obtained from receiver 211 can be forwarded to slave car 204 by first processing the command to be transmitted through induction coil transceiver 212, then to induction coil transceiver 214, through the wireless communication link established from connecting induction coil transceiver 212 to 214. Likewise, slave car 204 may send commands back to master car 202 to acknowledge that commands are received. Induction coil transceiver 214 may be hardwired to induction coil transceiver 216 on slave car 204. Induction coil transceiver 216 in turn constantly looks to link with another car. If no link is established, the system may recognize that the slave car without an echo command signifies the last car in a train. For example, in train 200, slave cars 204, 206, 208, and 210 have an established communication link. At the end of slave car 210, induction coil transceiver 228 does not have anything to link itself to, since there are no other cars located past this car. Thus, no link is established past induction coil transceiver 228, and the system recognizes that this car is the last car.

In order for a car to easily link to another car, a control system located on each car controls a front and rear coupler on the car. These couplers can be operated by circuitry located on each slave car, or can be completely mechanical. In addition, couplers 230-246 act to physically connect a locomotive to a car, or one car to another car. When cars are placed near each other, a specific procedure may occur to open and close the couplers. For example, if locomotive 202 is not physically connected to any other cars, its induction coil transceiver 212 will be searching for a car to link together with. As slave car 204 is placed near master car 202, coupler 230 is opened, and slave car 204 opens coupler 232. Once coupler 230 and 232 are physically connected (or before), a communication link is also established. Couplers 230 and 232 may then be closed to ensure a strong physical connection. This process continues for all subsequent slave cars, until the last car is connected to the train.

Commands by Car Position

In a preferred embodiment of the present invention, the command originator 202 is placed at the front of train 200. Because the system recognizes command originator 202 as being the first car in a train, any layout objects connected to command originator 202 can be located by its location relative to the first car. Each layout object may have the ability to perform a desired function or command. In system 200, slave car 204 responds to command 248 of opening/closing couplers 232 and 234. Slave car 206 responds to command 250 by making a bell sound mimicking the sound of a real train. Slave car 208 responds to command 252 by producing lights on this slave car. Slave car 210 has the ability to control lights, sound, and motor speed. Command 254, the function of changing the lights, sounds, and motor speed of slave car 210, is sent to slave car 210. It is important to note that each layout object/slave car can execute multiple functions, and is not limited to performing just one function at a time. Furthermore, a layout object may be motorized or non-motorized.

After the master car 202 is connected to the slave cars, commands can be sent from model train system base 14, to locomotive 202, where the signal is retrieved by receiver 211. Then the command is sent through the communication link to the slave cars. This system allows for a method of passing data to cars without the need for a receiver in each slave car. A command that is to be sent via the communication link contains three important parts:

1. The desired information
2. The desired position
3. The index to identify which slave car is currently processing the command The index is used to identify the location of each slave car relative to the master car. This process is done without the need for specific ID addresses for the individual slave cars, because the indexing is done relative to the master car. Furthermore, if the cars change order, they are automatically readdressed according to their relative position away from the master car. Because of this implementation, the need for absolute addressing using specific ID tags in each slave car is not required. Also, instead of an expensive microprocessor or controller in each car, a simple incrementing and comparing circuit can be used. An example of this is shown below. It is understood that this is one embodiment of the invention, but in no way limits the way that this indexing is implemented.

The receiver 211 in locomotive 202 receives command 252 from a user to turn on the lights in slave car 208. Command 252 will have the following information:

1. Information to signal the control-circuit of Car 3 to turn on the lights
2. Position number/Address=3 because Car 3 contains the lights to be turned on
3. Initially, index=0, because it is first received by the master car When a command is initially retrieved by receiver 211 in master car 202, the index inside the command is always set to zero. This is because the locomotive is the first car in the train, and the receiver is located on this car. The locomotive is recognized as the "zero car" in the train. The command will only be performed when the address matches the index number. Since address=3 and index=0 in this case, the command is forwarded to the next slave car through the wireless communication link.

Slave car 204 is the first car following master car 202. When command 252 is sent from the master car 202 to slave car 204, the index is incremented. Thus, the index changes from zero to one. Command 252 is currently stored in the first slave car located behind locomotive 202. The index reflects the order that a slave car is located away from a master car, i.e. the 1st slave car will contain an index=1. Because there is no match between the address and index (address=3 and index=1), command 252 is passed down again to the next slave car. Again, when the command is sent from slave car 204 to slave car 206, the index is incremented from one to two. Because address=3 and index=2, the command is passed down to the next slave car.

When the command is sent from slave car 206 to slave car 208, the index is incremented to 3, which reflects that the command is currently being stored in the 3rd slave car. The control circuit of slave car 208 contains logic circuitry to compare the address to the index, and recognizes that a match has occurred, i.e. address=3 and index=3. After a match is recognized, the command is performed, i.e. the lights on Car 3 are turned on.

Although one embodiment has been described above, the present invention can be embodied in other specific ways without departing from the essential characteristics of the invention. For example, rather than incrementing the index by a positive value (i.e. positive one), the index may start with a number corresponding to the number of cars and may be incremented by a negative number (i.e. negative one).

Reporter Car

The above process can also be implemented to send commands pertaining to other train functions, such as opening/closing couplers, producing train-like sounds, increasing motor speed, etc. Further embodiments of the present invention include the ability of placing a specific type of model train car known as a reporter car in any location within a train. This reporter car contains the ability to communicate with a remote or model train accessories through an RF wireless link. Specific data about the train, such as the number of cars located within the train, the type of cargo each car is carrying, and other information can be sent from the reporter car through the RF wireless link to a remote. This RF wireless link may act as a bi-directional link.

Control of Accessories

In addition, it should be appreciated that communication may involve the reporter car or engine and model train accessories, or between the remote or base station and the accessories directly. Examples of such model train accessories are, but not limited to, switches on a rail track, railroad lights located beside a train track, sound systems located on a railroad station, etc. An example of dynamically interacting between a model train and model train accessories is described below. If a locomotive were to pull a group of train cars, where the number of train cars exceeds a specified limit, a railroad station could receive the information regarding the train (i.e., the number of cars that make up the train) from a reporter car and compare this to a predetermined threshold limit. If the train contains too many cars, then the railroad station could produce warning lights and bell sounds signaling to the user that too many cars are connected on a train. Other examples of dynamically interacting between a model train and model train accessories exist. Also, a user could direct specific commands to be performed on model train accessories, such as a user remotely choosing to switch a railroad track, so that a train can change direction. In one embodiment, multiple accessories could be linked, so that multiple commands could be sent to a station house with a receiver. A first command with an index of 0 could cause the station house to emit a noise, a command with an index of one could be passed to a light near the tracks, and a command with an index of two could be passed to a switch. The command could be received by a wireless receiver directly, or a receiver coupled to the track for receiving commands.

VARIATIONS AND ADVANTAGES

Train Link IR transceivers are placed in components on a train layout. These include but are not limited to engines, rolling stock, and accessories. Train Link IR transceivers are constantly looking for a links to other transceivers on the layout. Train Link IR Units can operate as an independent unit or with another Train Link IR Unit in group. Train Link IR Units can connect to a Master Train Link IR Unit. The master can then send commands though the IR links to the now Slave Train Link IR Units. Each unit takes the data received and passes on to the next unit in the link (the master could be in an engine, reporter car, other car, accessory, etc.). This allows for a cheap method of passing data between items on the layout w/o the need for a wireless receiver in each one.

The position addressing mechanism of this invention removes the need for absolute addressing of the wireless units. It allows for logical addressing. The 4th unit is always addressed as unit 4 regardless of which the type of unit. If the units change order they are automatically readdresses so that the numbers are correct. Bad addresses can be automatically range checked without the need to interpret the entire data packet.

There are a number of applications and advantages of the invention. It allows a Train Link Enabled Train to be able to automatically figure out all the pieces that are within the train. It simplifies the addressing of all command operating portions within a train. It simplifies coupling and uncoupling. When an uncoupling command is sent to a corresponding coupler in a group of Train Link enabled cars, the target car can also send the corresponding command to the car to which it is attached to open its coupler. This will ensure that the couplers are always released properly. One application is when two Train-Link enabled cars approach each other, they can establish a link and automatically open their couplers to couple to the oncoming car or train. Once a Train Link enabled car is connected to a master train, for example, the car can now tell which end is closest to the engine. This information allows for dynamic control of couplers. The front coupler can always become the coupler nearest to the master unit and visa versa.

A Train Link IR Unit or Group of Units could be run over a sensor located near the track. The sensor could then pick up everything about the train such as but not limited to number of units, cargo, and name or units. A Reporter Unit can be placed within a Train Link Enabled Group. This unit could have a RF wireless link to a main base or remotes. It would report all the Train Link Unit to the base or remotes. It would for example report the type of cargo that each Train Link Unit is carrying. The remotes and accessories could display the information gathered. Train Link can operate but is not limited to couplers, sounds, lights, and motors. Train Link can send any type of information such as but not limited to the type of unit, cargo of the unit, units location in group, and the status of the unit.

It will be understood that modifications and variations may be effected without departing from the scope of the novel concepts of the present invention. Accordingly, the foregoing description is intended to be illustrative, but not limiting, of the scope of the invention which is set forth in the following claims.

What is claimed is:

1. A model train system comprising;

at least one command originator;

a plurality of layout objects; and a communication link between said command originator and said plurality of layout objects for providing a command to one of said plurality of layout objects, said command comprising:

a desired information to be implemented by said one of said plurality of layout objects;

a desired position that corresponds to a location of said one of said plurality of layout objects; and a dynamic index that is incremented as the command is passed from a preceding one of said plurality of layout objects to said one of said plurality of layout objects, said desired information being implemented by said one of said plurality of layout objects if there is correspondence between said desired position and said dynamic index;

wherein the command originator is adapted to forward commands to said layout objects with addressing based on a location of the layout objects relative to the command originator without the use of absolute addressing.

2. The model train system of claim 1, wherein said one of said plurality of layout objects comprises a non-motorized model train car.

3. The model train system of claim 1, wherein said one of said plurality of layout objects comprises a motorized model train car.

4. The model train system of claim 1, wherein said one of said plurality of layout objects comprises a model train accessory.

5. The model train system of claim 1, wherein said at least one command originator comprises a model train car.

6. The model train system of claim 1, wherein said at least one command originator comprises a motorized model train car.

7. The model train system of claim 1, wherein said at least one command originator comprises a model train accessory.

8. The model train system of claim 1, wherein said at least one command originator comprises a model train system base.

9. The model train system of claim 1, wherein said communication link is wired.

10. The model train system of claim 1, wherein said communication link is wireless.

11. The model train system of claim 9, wherein the wired communication link is implemented via a coupler connection.

12. The model train system of claim 10, wherein the wireless communication link is implemented with induction coils.

13. The model train system of claim 10, wherein the wireless communication link is implemented with infrared transceivers.

14. The model train system of claim 10, wherein the wireless communication link is implemented with radio frequency.

15. The model train system of claim 1, wherein said one of said plurality of layout objects comprises a model train car.

16. A model train system comprising:

a first car adapted to receive a signal from a base station, said signal comprising at least one command, position information, and an index, wherein said position information identifies a position of a target car in said model train system;

a plurality of cars that are at least indirectly connected to said first car and are adapted to (1) increment said index when transmitting said signal from a previous one of said plurality of cars to a subsequent one of said plurality of cars and (2) initiate an effect if there is correspondence between a current state of said index and said position information; and a communication link between said plurality of cars for transmitting said signal from said first car to said target car, wherein said plurality of cars comprises at least said target car.

17. A model train system comprising:

at least one command originator being adapted to receive a signal from a base station; and a plurality of layout objects in communication with said at least one command originator, each one of said plurality of layout objects being adapted to (1) receive said signal comprising at least one command, position information and an index, wherein said position information identifies a position of one of said plurality of layout objects in said model train system, (2) increment said index if a current state of said index does not match said position information, and (3) initiate said command if said current state of said index matches said position information.

18. A model train system comprising:

at least one command originator having a transceiver;

a plurality of layout objects in communication with said at least one command originator, at least one of said plurality of layout objects being adapted to (1) receive a signal comprising at least one command, position information and an index, wherein said position information identifies a position of one of said plurality of layout objects, (2) modify said index if a current state of said index does not match said position information, and (3) initiate said command if said current state of said index matches said position information.

19. The model train system of claim 18, wherein said at least one of said plurality of layout objects is further adapted to increment said index if said current state of said index does not match said position information.

20. The model train system of claim 18, wherein a transceiver is placed at an end of each of the plurality of layout objects.

* * * * *